US011009824B2

(12) United States Patent
Takezawa

(10) Patent No.: US 11,009,824 B2
(45) Date of Patent: May 18, 2021

(54) FIXING DEVICE ROTATING FIXING MEMBER OR PRESSING MEMBER WHILE MEDIUM IS EXTRACTED AND IMAGE FORMING APPARATUS INCLUDING THE SAME

(71) Applicant: KYOCERA Document Solutions Inc., Osaka (JP)

(72) Inventor: Mashio Takezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 82 days.

(21) Appl. No.: 16/479,522

(22) PCT Filed: Oct. 25, 2018

(86) PCT No.: PCT/JP2018/039724
§ 371 (c)(1),
(2) Date: Jul. 19, 2019

(87) PCT Pub. No.: WO2019/130776
PCT Pub. Date: Jul. 4, 2019

(65) Prior Publication Data

US 2019/0339641 A1 Nov. 7, 2019

(30) Foreign Application Priority Data

Dec. 27, 2017 (JP) ..... JP2017-251451

(51) Int. Cl.
*G03G 15/00* (2006.01)
*G03G 15/20* (2006.01)

(52) U.S. Cl.
CPC ..... *G03G 15/70* (2013.01); *G03G 15/2028* (2013.01); *G03G 15/5012* (2013.01);
(Continued)

(58) Field of Classification Search
CPC ..... G03G 15/70; G03G 15/2028; G03G 15/2035; G03G 15/5012; G03G 15/6573; G03G 2215/00548; G03G 2215/2003
See application file for complete search history.

(56) References Cited

U.S. PATENT DOCUMENTS

2012/0217702 A1 8/2012 Seki
2018/0164734 A1* 6/2018 Saito ..... G03G 15/2035

FOREIGN PATENT DOCUMENTS

JP H01187148 A 7/1989
JP 2006076789 A 3/2006
(Continued)

OTHER PUBLICATIONS

International Search Report issued in PCT/JP2018/039724; dated Dec. 18, 2018.

*Primary Examiner* — Joseph S Wong
(74) *Attorney, Agent, or Firm* — Studebaker & Brackett PC

(57) ABSTRACT

A fixing device (7) includes a fixing member (21), a pressing member (22), a rotation detector (41), and an auxiliary driving part (42). The fixing member (21), with rotating around an axis, heats a toner image on a medium (S). The pressing member (22), with rotating around an axis, forms a pressing area (N) with the fixing member (21) and presses toner on the medium (S) passing through the pressing area (N). The rotation detector (41), when the medium (S) stops while being sandwiched between the fixing member (21) and the pressing member (22), detects rotation of the fixing member (21) or the pressing member (22) generated in a process of extracting the medium (S) toward an upstream side or a downstream side in a passing direction. The auxiliary driving part (42), while the medium (S) is being extracted, determines a rotating direction of the fixing member (21) or the pressing member (22) based on a detection
(Continued)

result by the rotation detector (41), and rotates the fixing member (21) or the pressing member (22) in the rotating direction.

6 Claims, 14 Drawing Sheets

(52) U.S. Cl.
CPC ..... *G03G 15/6573* (2013.01); *G03G 2215/00548* (2013.01); *G03G 2215/2003* (2013.01)

(56) References Cited

FOREIGN PATENT DOCUMENTS

| | | | |
|---|---|---|---|
| JP | 2009265331 | A | 11/2009 |
| JP | 2012176827 | A | 9/2012 |
| JP | 2017076091 | A | 4/2017 |
| JP | 2017090659 | A | 5/2017 |

* cited by examiner

FIXING DEVICE ROTATING FIXING MEMBER OR PRESSING MEMBER WHILE MEDIUM IS EXTRACTED AND IMAGE FORMING APPARATUS INCLUDING THE SAME

TECHNICAL FIELD

The present invention relates to a fixing device that fixes a toner image on a medium and an image forming apparatus.

BACKGROUND ART

An electrographic image forming apparatus includes a fixing device that heats and fixes a toner image on a medium passing through a fixing member and a pressing member. In such a fixing device, the medium may stop (i.e., lodge) while being sandwiched between the fixing member and the pressing member.

Various techniques are proposed on the above stated matter. For example, in a laser printer stated in Patent Document 1, driving gears such as a recording paper transfer from a main motor to a fixing roller are reversely rotated when a recording paper remains for a predetermined period with remaining a non-fixing part on a delivery sensor. In the laser printer, the fixing roller is reversely rotated automatically, so that the recording paper causing a fixing jam is extracted only toward an inner side of the apparatus (i.e., a photoreceptor side).

PRIOR ART DOCUMENT

Patent Document

[Patent Document 1] Japanese patent laid-open publication No. H01-187148

SUMMARY OF INVENTION

Technical Problem

However, in the above-stated laser printer, the recording paper (i.e., the medium) regardless of whether extracted or not is automatically transferred to the inner side of the apparatus. As a result, the recording paper may be forced to be pressed onto a surface of the inner side of the apparatus. In this case, a shape of the recording paper may greatly collapse and the fixing jam may become difficult to be solved.

When a user attempts to extract the recording paper toward an outer side of the apparatus against the reverse rotation of the fixing roller, the recording paper cannot be easily extracted with small force. Furthermore, in this case, if the recording paper is torn to pieces in the apparatus, there is a problem that it takes wasteful time to remove the pieces of the torn recording paper.

To solve the above-stated problem, the present invention provides an image forming apparatus and a fixing device capable of easily executing an appropriate jam treatment.

Solution to Problem

A fixing device in accordance with the present invention includes a fixing member, a pressing member, a rotation detector, and an auxiliary driving part. The fixing member, with rotating around an axis thereof, heats a toner image on a medium. The pressing member, with rotating around an axis thereof, forms a pressing area with the fixing member and presses toner on the medium passing through the pressing area. The rotation detector, when the medium stops while being sandwiched between the fixing member and the pressing member, detects rotation of the fixing member or the pressing member generated in a process of extracting the medium toward an upstream side or a downstream side in a passing direction. The auxiliary driving part, while the medium is being extracted, determines a rotating direction of the fixing member or the pressing member based on a detection result by the rotation detector, and rotates the fixing member or the pressing member in the rotating direction.

An image forming apparatus according to the present invention includes the above-stated fixing device.

Advantageous Effects of Invention

According to the present invention, an appropriate jam treatment can be easily executed in the fixing device.

DESCRIPTION OF EMBODIMENTS

Hereinafter, an embodiment of the present invention will be described with reference to attached figures. Arrows "Fr", "Rr", "L", "R", "U", and "D" shown in the figures respectively indicate "front", "rear", "left", "right", "upward" and "downward". Furthermore, "upstream" and "downstream", and expressions being similar thereto respectively indicate "upstream" and "downstream" in a conveying direction (a passing direction) of a sheet S, and similar notions.

<<Overall Configuration of Color Printer>>

Figure 1:
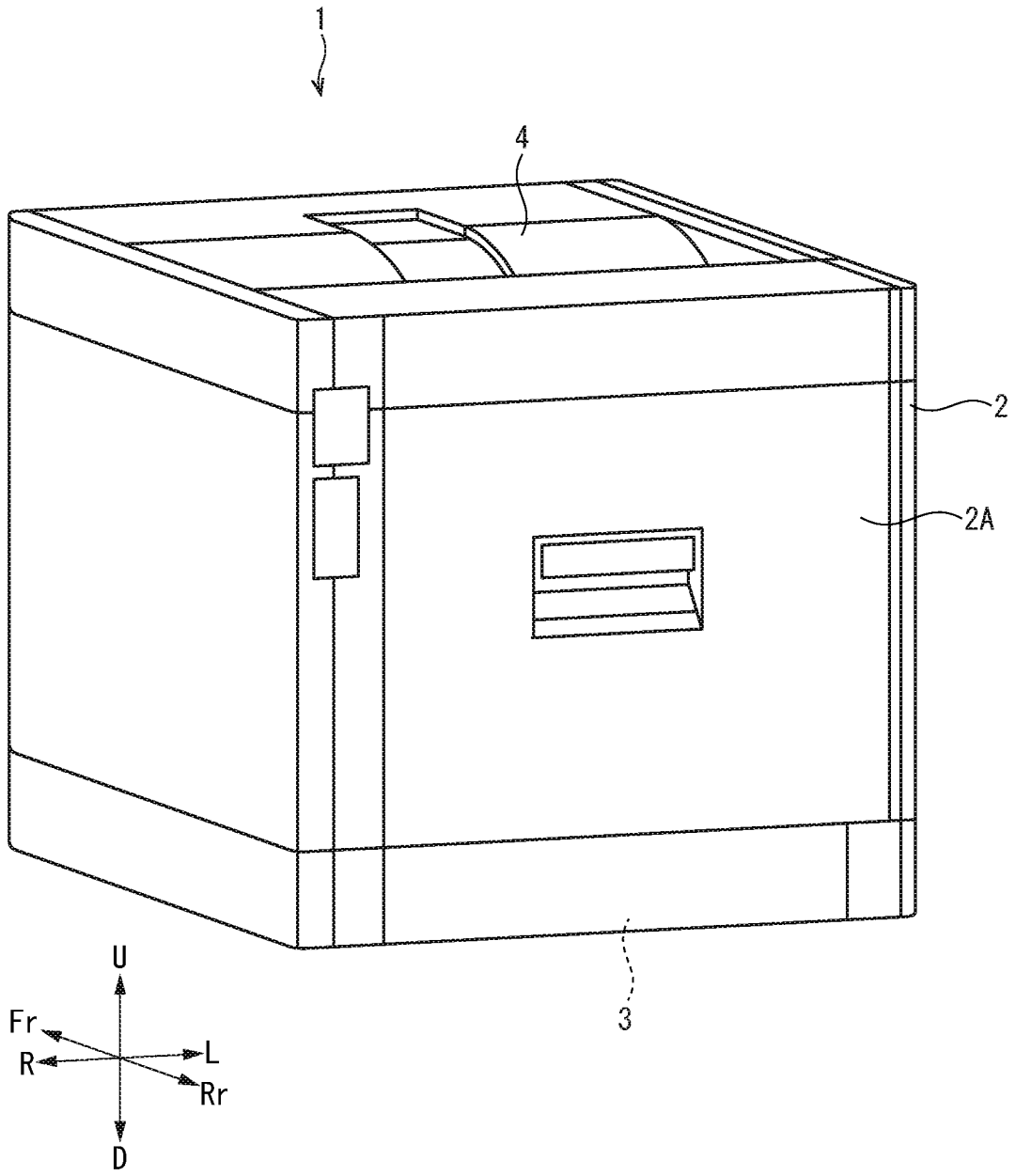
FIG. 1 is a perspective view that shows a color printer according to an embodiment of the present invention.
Figure 2:
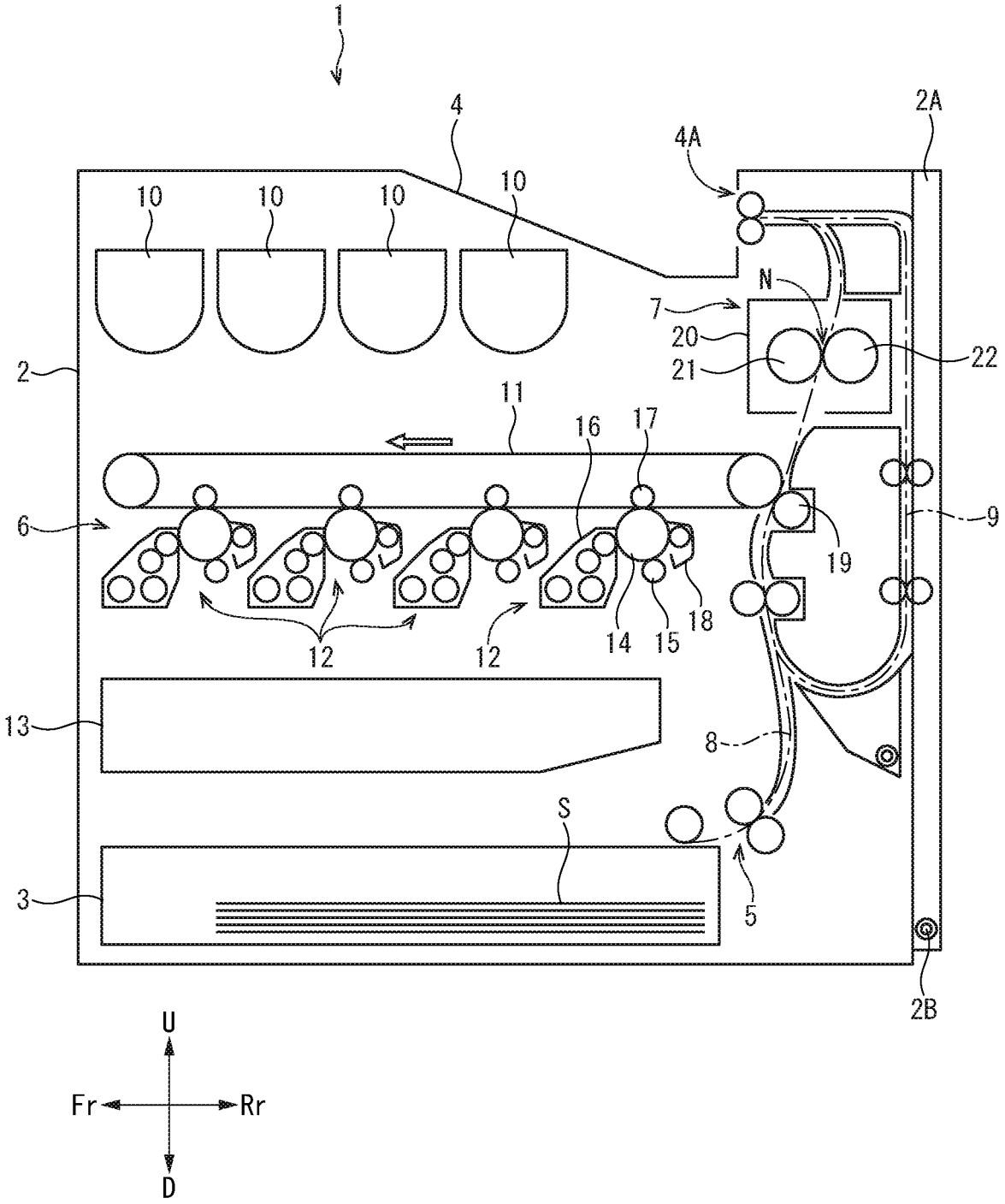
FIG. 2 is a schematic view (a front view) that shows an internal structure of the color printer according to the embodiment of the present invention.

With reference to FIGS. 1 and 2, a color printer 1 as an example of an image forming apparatus will be described. FIG. 1 is a perspective view that shows the color printer 1. FIG. 2 is a schematic view (a front view) that shows an internal structure of the color printer 1.

As shown in FIG. 1, the color printer 1 includes main body 2 configuring a substantially rectangular parallelepiped-appearance. In a lower part of the main body 2, a sheet feeding cartridge 3 storing paper sheets S (media) is attachably and detachably provided. In an upper surface of the main body 2, a sheet ejecting tray 4 is provided. In an upper part of the main body 2, a sheet ejection port 4A that opens toward the sheet ejecting tray 4 is formed (see FIG. 2). The sheet S is not limited to a paper sheet and can be a resin sheet or the like.

As shown in FIG. 2, the color printer 1 includes a sheet feeding device 5, an imaging device 6, and a fixing device 7. The sheet feeding device 5 is provided at an upstream end of a conveying path 8 substantially-sigmoidally extending from the sheet feeding cartridge 3 to the sheet ejection port 4A. The fixing device 7 is provided at a downstream side of the conveying path 8, and the imaging device 6 is provided between the sheet feeding device 5 and the fixing device 7 in the conveying path 8. In a rear side of the conveying path 8, a reverse conveying path 9 for conveying again the inverted sheet S to the imaging device 6 is provided.

The imaging device 6 includes four toner containers 10, an intermediate transferring belt 11, four drum units 12, and an optical scanning device 13. The four toner containers 10 contain four-colored (yellow, magenta, cyan, and black) toners (developers). Each drum unit 12 includes a photosensitive drum 14, a charger 15, a development device 16, a primary transfer roller 17, and a cleaning device 18. The primary transfer roller 17 is provided so as to sandwich the intermediate transferring belt 11 with the photosensitive drum 14. A secondary transfer roller 19 is in contact with a rear side of the intermediate transferring belt 11 so as to form a transferring nip.

A control device 47 of the color printer 1 appropriately controls components so as to execute image forming process as follows. The chargers 15 charge surfaces of the photosensitive drums 14. The photosensitive drums 14 receive scanning lights emitted from the optical scanning device 13 and carry electrostatic latent images. The development devices 16 develop the electrostatic latent images on the photosensitive drums 14 to form toner images using the toners supplied from the toner containers 10. The primary transfer rollers 17 primarily transfer the toner images on the photosensitive drums 14 to the rotating intermediate transferring belt 11. The intermediate transferring belt 11 rotates and carries a full-colored toner image by overlapping the four-colored toner images. The sheet S is fed out by the sheet feeding device 5 from the sheet feeding cartridge 3 to the conveying path 8. The secondary transfer roller 19 secondary transfers the toner image on the intermediate transferring belt 11 to a surface of the sheet S passing through the transferring nip. The fixing device 7 fixes the toner image on the sheet S. Afterward, the sheet S is ejected from the sheet ejection port 4A to the sheet ejecting tray 4. Each cleaning device 18 removes the toner remaining on the photosensitive drum 14.

When both sides of the sheet S are printed, the sheet S having passed through the fixing device 7 is switched back at a downstream end of the conveying path 8 and sent to the reverse conveying path 9. The sheet S enters again the conveying path 8 from the reverse conveying path 9, and is conveyed again toward the imaging device 6. Afterward, an image is also formed on the reverse surface of the sheet S.

<<Fixing Device>>

Figure 3:
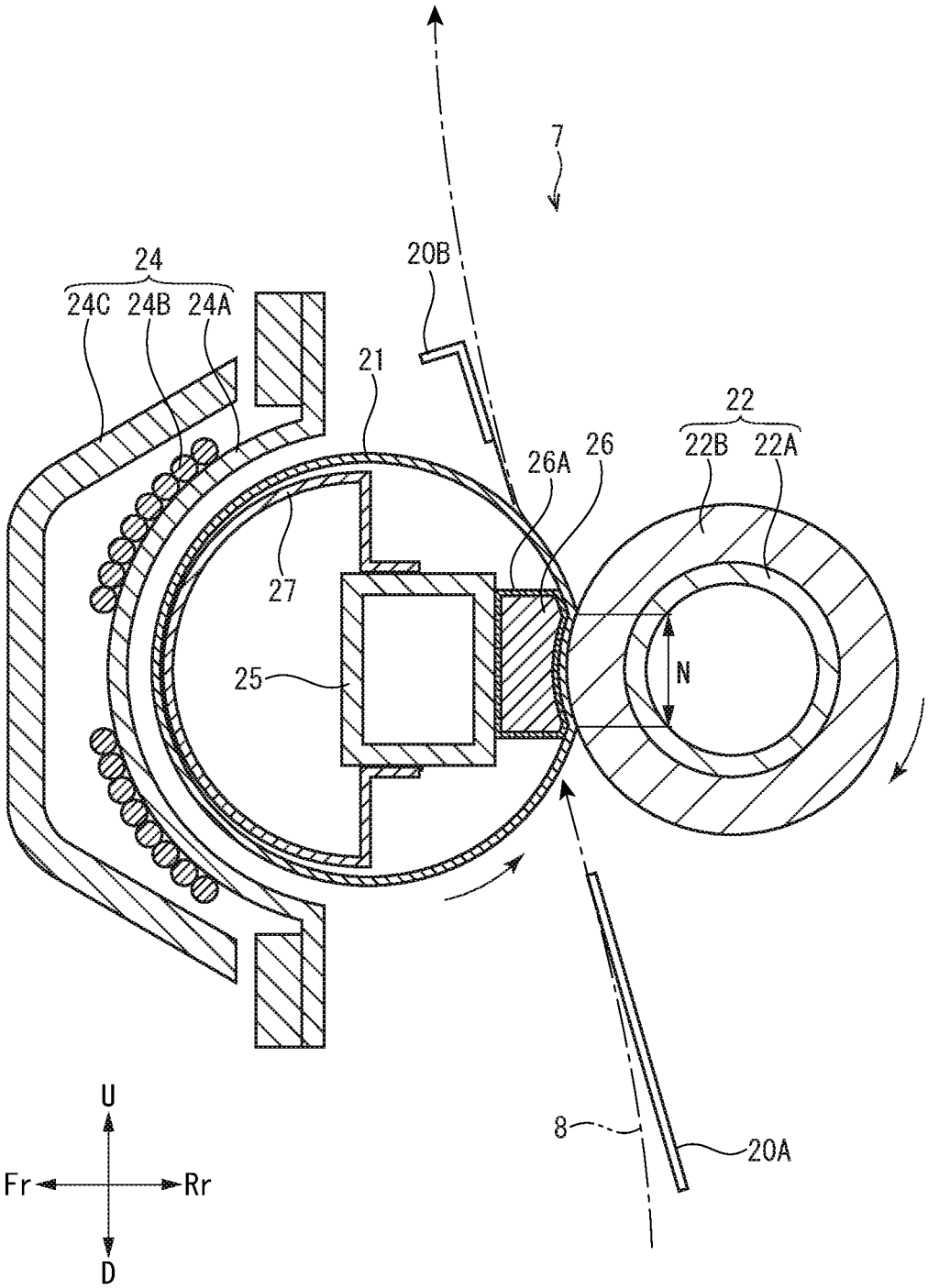
FIG. 3 is a sectional view that schematically shows a fixing device according to the embodiment of the present invention.
Figure 4:
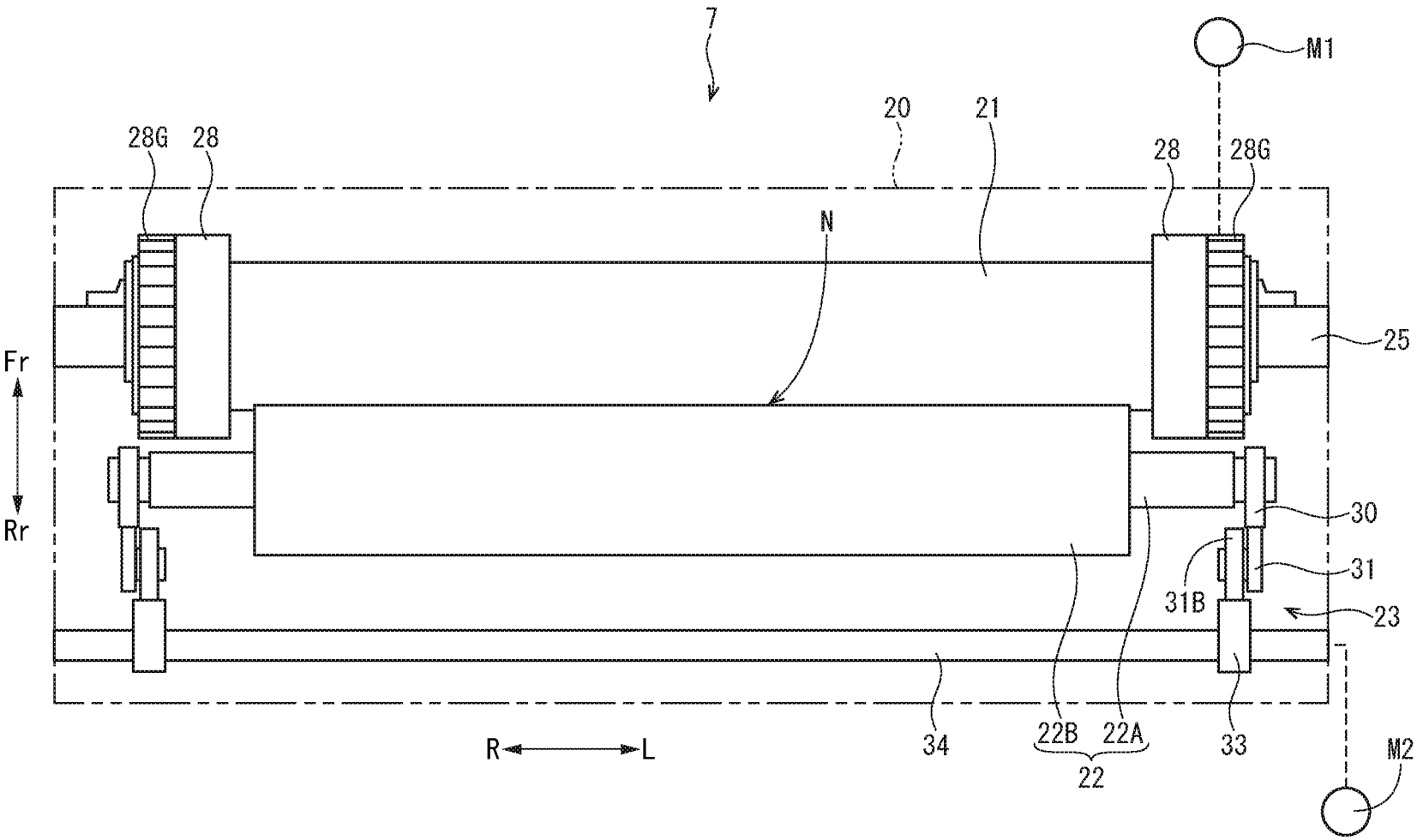
FIG. 4 is a plan view that schematically shows the fixing device according to the embodiment of the present invention.
Figure 5:
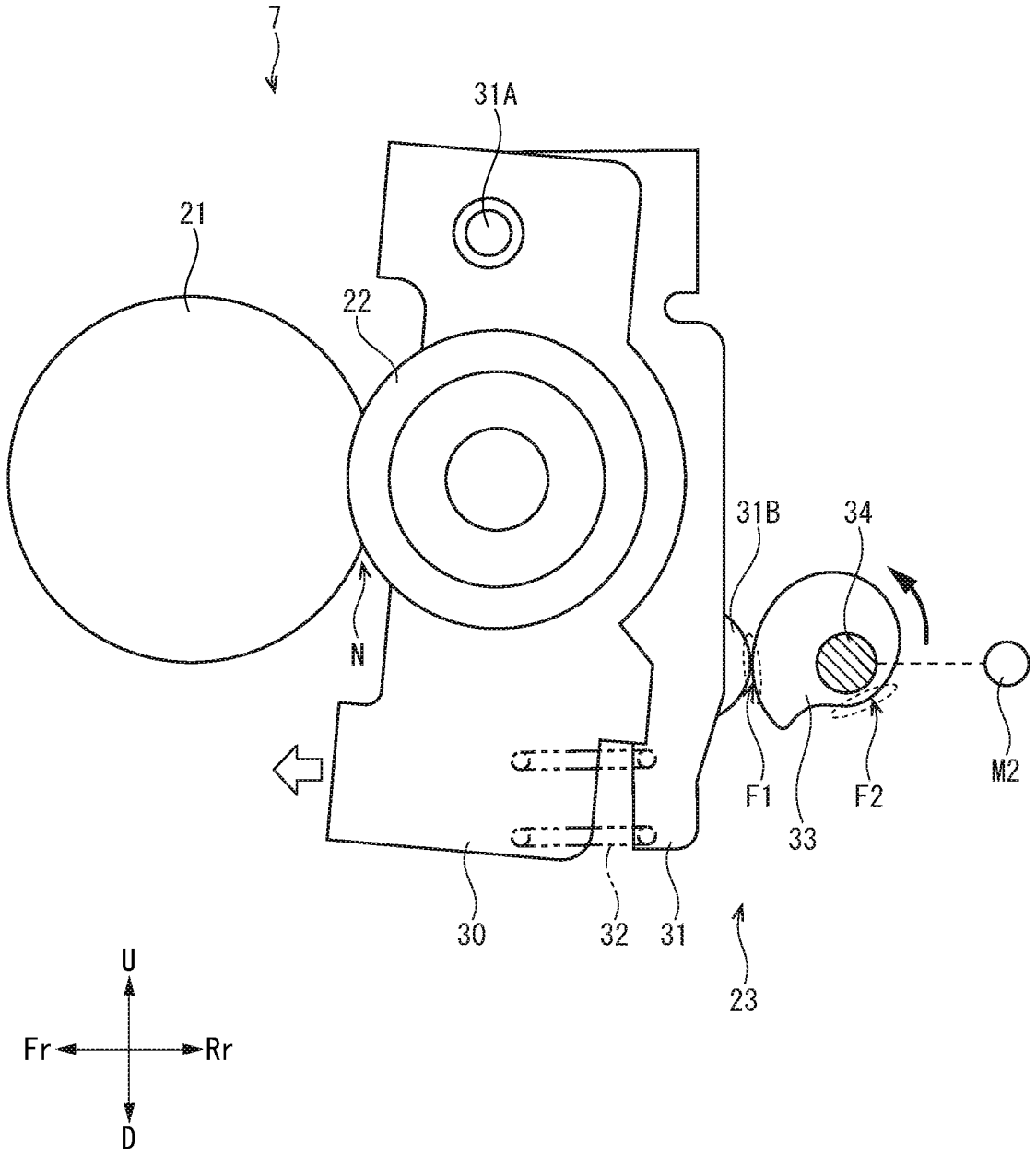
FIG. 5 is a side view that shows a pressure adjusting part and so forth (a pressurized condition) of the fixing device according to the embodiment of the present invention.
Figure 6:
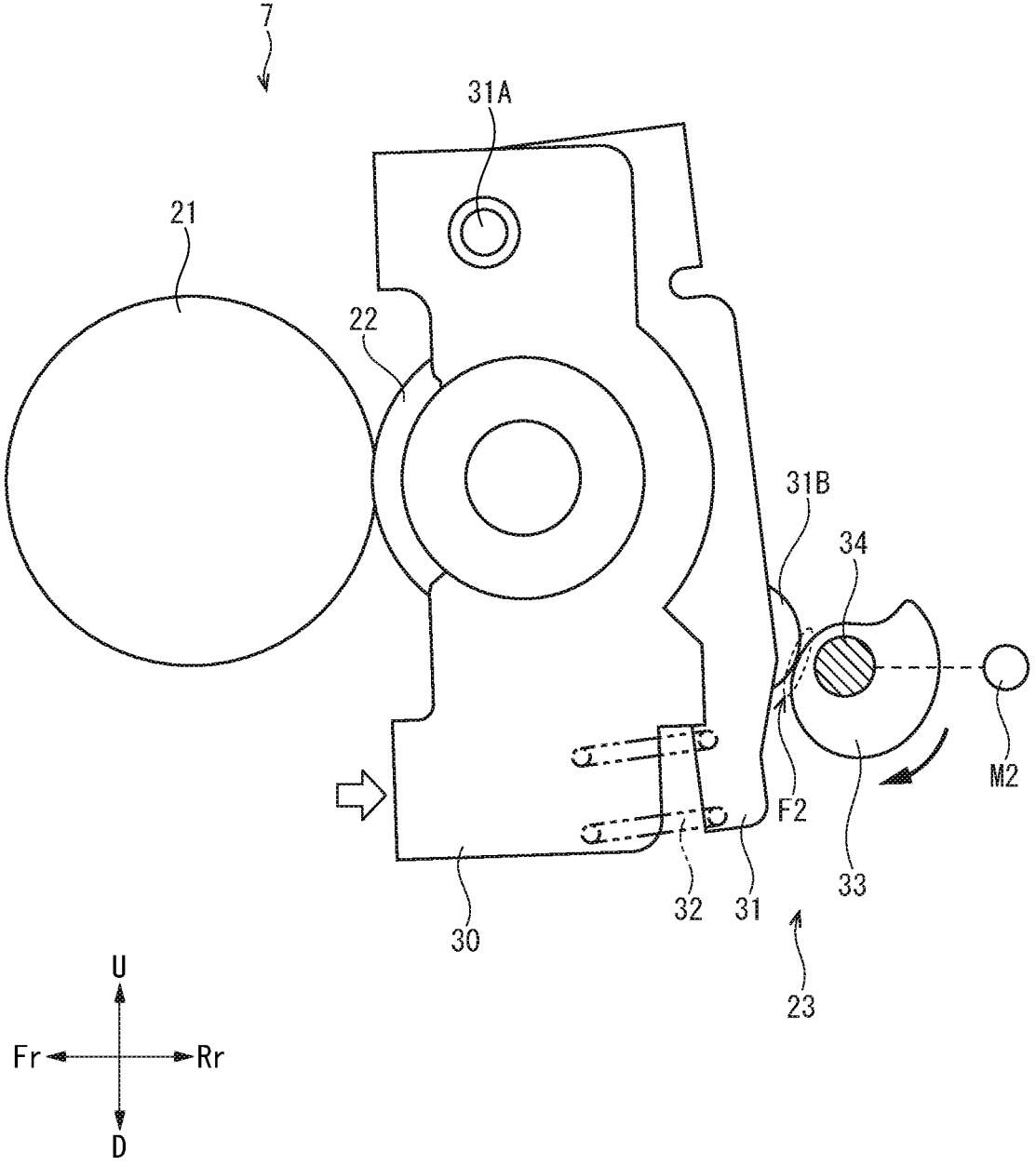
FIG. 6 is a side view that shows the pressure adjusting part and so forth (a depressurized condition) of the fixing device according to the embodiment of the present invention.
Figure 7:
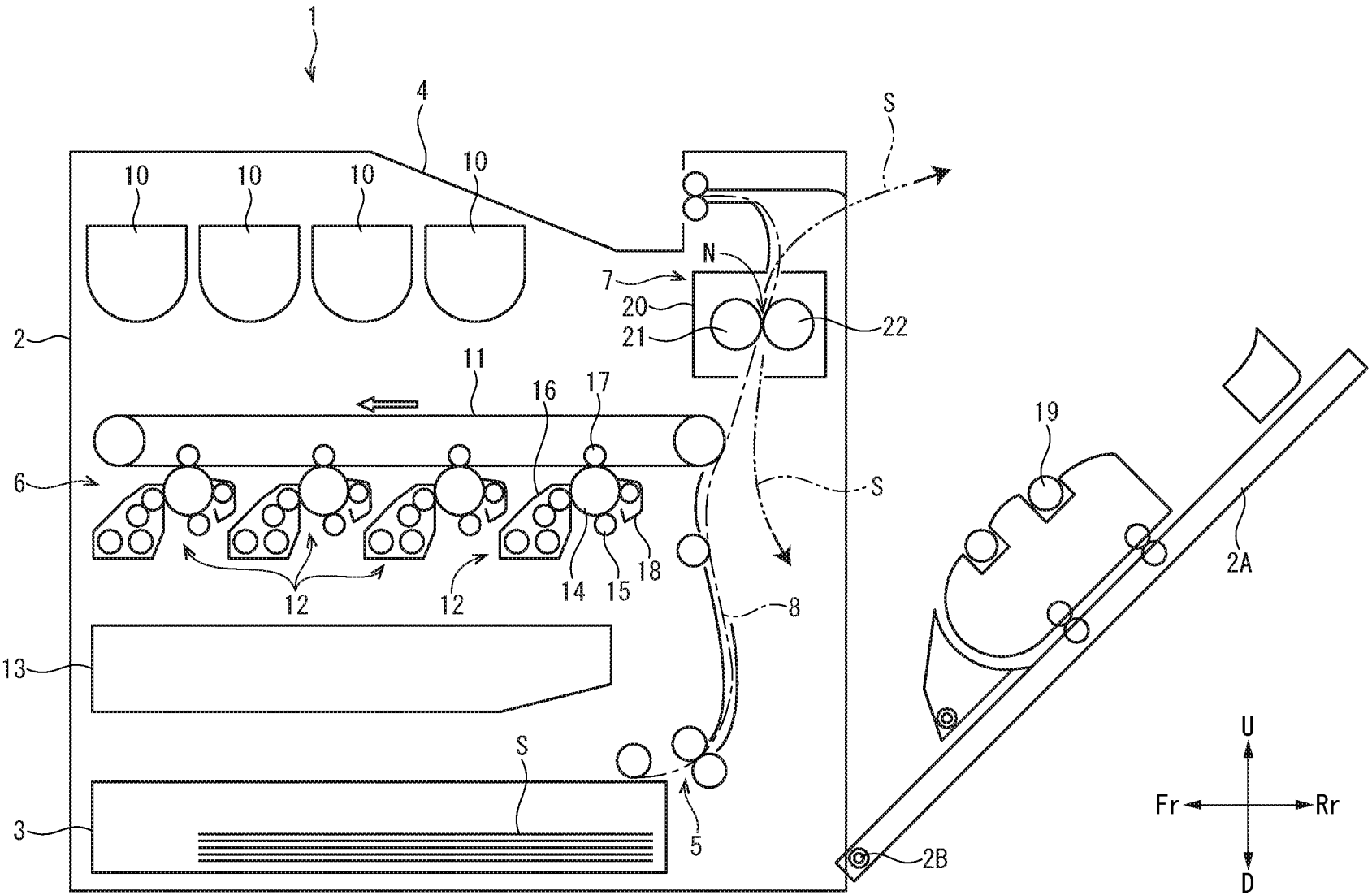
FIG. 7 is a schematic view (a front view) that schematically shows an opened opening/closing door of the color printer according to the embodiment of the present invention.

The fixing device 7 will be described with reference to FIGS. 3 to 9. FIG. 3 is a sectional view that schematically shows the fixing device 7. FIG. 4 is a plan view that schematically shows the fixing device 7. FIG. 5 is a side view that shows a pressure adjusting part 23 and so forth (a pressurized condition) of the fixing device 7. FIG. 6 is a side view that shows the pressure adjusting part and so forth (a depressurized condition). FIG. 7 is a schematic view (a front view) that schematically shows an opened opening/closing door 2A of the color printer 1.

As shown in FIGS. 3 and 4, the fixing device 7 includes a housing 20, a fixing belt 21, a pressing roller 22, a pressure adjusting part 23, and a heat generating unit 24. The housing 20 is supported by the main body 2 (see FIG. 2). The fixing belt 21 and the pressing roller 22 are provided rotatable around their respective axes in the housing 20. The pressure adjusting part 23 is located with facing the pressing roller 22, and the heat generating unit 24 is located with facing the fixing belt 21.

<Housing>

The housing 20 is formed in a substantially rectangular parallelepiped shape elongated in a right-left direction (see FIG. 4). In the housing 20, a part of the conveying path 8 through which the sheet S passes is formed. In a down side of the housing 20, an entry guide 20A for guiding the sheet S to a contacting portion of the fixing belt 21 and the pressing roller 22 (i.e., a pressing area N) is provided (see FIG. 3). In the upper side of the housing 20, a separation claw 20B for separating the sheet S having passed through the pressing area N from the fixing belt 21 is provided (see FIG. 3).

<Fixing Belt>

As shown in FIGS. 3 and 4, the fixing belt 21 as an example of a fixing member is an endless belt and is formed in a substantially cylindrical shape elongated in the right-left direction. The fixing belt 21 is, for example, formed of a synthetic resin etc. having thermal resistance and elasticity.

As shown in FIG. 3, in the fixing belt 21, a supporting member 25, a pressing pad 26, and a belt guide 27 are provided.

The supporting member 25 is, for example, formed in a substantially rectangular cylindrical shape elongated in the right-left direction (i.e., an axial direction) using metallic material such as iron or stainless steel. The supporting member 25 penetrates the fixing belt 21 in the axial direction. Both ends in the axial direction of the supporting member 25 are elongated outside the fixing belt 21 and are fixed to the housing 20 (see FIG. 4).

The pressing pad 26 is fixed on a rear surface of the supporting member 25. The pressing pad 26 is, for example, formed in a substantially thick-plate shape elongated in the axial direction using a synthetic resin etc. having thermal resistance. The pressing pad 26 is wrapped with a sliding sheet 26A for decreasing friction against the fixing belt 21. The sliding sheet 26A is, for example, a textile woven using PTFE fiber or the like. The pressing pad 26 has a function to receive the pressing roller 22 pressed across the fixing belt 21.

The belt guide 27 is fixed in a front side of the supporting member 25. The belt guide 27 is, for example, formed in a substantially half-cylindrical shape elongated in the axial direction using a metallic material such as stainless steel having magnetism. A curved surface of the belt guide 27 is in contact with a front inner surface of the fixing belt 21. The belt guide 27 is located to face the heat generating unit 24 across the fixing belt 21. The belt guide 27 has a function to retain the substantially cylindrical shape of the fixing belt 21.

As shown in FIG. 4, a pair of caps 28 is fit on both right and left sides of the fixing belt 21. The cap 28 is formed in a substantially annular shape having an external diameter greater than an external diameter of the fixing belt 21. The cap 28 has a shape retaining part (not shown) being in slidable contact with the inner surface of the fixing belt 21. The fixing belt 21 is rotatably supported by the supporting member 25 through the pair of the caps 28.

Fixing gears 28G are integrally formed on external surfaces in the axial direction of the caps 28. The fixing gear 28G is a so-called spur gear that is provided on the same axial center of the cap 28. A driving motor M1 (a pinion gear G1) is connected to the fixing gear 28G of the left cap 28 through a gear train 29 including a plurality of gears (see FIG. 8).

<Pressing Roller>

As shown in FIGS. 3 and 4, the pressing roller 22 as an example of a pressing member is formed in a substantially cylindrical shape elongated in the right-left direction, and located in a rear side of the fixing belt 21. The pressing roller 22 includes a metallic core metal 22A and an elastic layer 22B such as silicone sponge laminated on an outer peripheral surface of the metallic core metal 22A. Both ends in the axial direction of the pressing roller 22 (the core metal 22A) are rotatably supported by a pair of movable frames 30 (see FIG. 4). The movable frames 30 are supported by the housing 20 so as to swing in a front-rear direction (in a direction separating from and contacting to the fixing belt 21).

<Pressure Adjusting Part>

As shown in FIGS. 4 and 5, the pressure adjusting part 23 includes a pair of pressing arms 31, a pair of pressing springs 32, a pair of eccentric cams 33, and a cam motor M2.

The pressing arm 31 is located in a rear side of the movable frame 30 and is rotatably supported by a rotation shaft 31A. A working roller 31B is rotatably supported on an inner lower surface of the pressing arm 31. The pressing spring 32 is a coil spring spanned between the movable frame 30 and the pressing arm 31 in a lower part of the pressing arm 31. The pressing spring 32 biases the movable frame 30 and the pressing arm 31 in a direction separating from each other.

The eccentric cam 33 is fixed to a cam connecting shaft 34 elongated in substantially parallel with the pressing roller 22. Both ends in the axial direction of the cam connecting shaft 34 are rotatably supported by the housing 20. The eccentric cam 33 is a so-called disk cam in which distances (eccentric radii) from a rotation center (the cam connecting shaft 34) to an outer peripheral surface are irregular. The working roller 31B of the pressing arm 31 is biased by the pressing spring 32 and pressed onto the outer peripheral surface of the eccentric cam 33. Regarding a circumference of the eccentric cam 33, a pressurizing cam surface F1 and a depressurizing cam surface F2 with an eccentric radius greater than that of the pressurizing cam surface F1 are formed in series. The cam motor M2 is connected to a left end part of the cam connecting shaft 34 through a gear train (not shown).

<Operations of Pressure Adjusting Part>

Driven by the cam motor M2, the eccentric cam 33 rotates forwardly and reversely around the cam connecting shaft 34, which causes the pressing arm 31 to reciprocate (swing) around the rotation shaft 31A in the front-rear direction. As shown in FIG. 5, for example, when the pressurizing cam surface F1 of the eccentric cam 33 comes into contact with the working roller 31B, the pressing arm 31 and movable frame 30 are put in a state to be pressed forward. In that state, the pressing roller 22 is intensely pressed so as to bite the fixing belt 21, and it becomes a pressurized condition in which the pressing area N formed between the fixing belt 21 and the pressing roller 22 is pressurized. In contrast, as shown in FIG. 6, when the eccentric cam 33 rotates until the depressurizing cam surface F2 comes into contact with the working roller 31B, the pressing arm 31 and movable frame 30 are biased by the pressing spring 32 to move rearward. The pressing roller 22 moves in a direction separating from the fixing belt 21, and it becomes a depressurized condition in which the pressing area N is depressurized. In the depressurized condition, the pressing roller 22 is in slight contact with the fixing belt 21, the pressure becomes lower than that in the pressurized condition. The pressing area N is a region from an upstream position in which the pressure is 0 Pa to a downstream position in which the pressure returns to 0 Pa after passing through a position in which the pressure becomes a maximum.

<Heat Generating Unit>

As shown in FIG. 3, the heat generating unit 24 is located in front of the fixing belt 21 across a gap. The heat generating unit 24 includes a coil holder 24A, an IH coil 24B, and an arch core 24C. The coil holder 24A is formed in a substantially half-cylindrical shape elongated in the right-left direction along an upper outer surface of the fixing belt 21. The IH coil 24B is retained by the coil holder 24A and covered by the arch core 24C formed of a ferromagnetic material such as a ferrite. The heat generating unit 24 of an induction heating type as a heat source is located outside the fixing belt 21. Alternatively, a halogen heater, a carbon heater, or the like may be located inside the fixing belt 21.

In the housing 20, a temperature sensor (not shown) is provided to detect a surface temperature of the fixing belt 21. The driving motor M1, the cam motor M2, the heat generating unit 24 (the IH coil 24B), the temperature sensor, and so forth are electrically connected with the control device 47 of the color printer 1 through various driving circuits (not shown). The control device 47 controls the connected devices or the like.

<<Operations of Fixing Device>>

Hereinafter, operations of the fixing device 7 (the fixing processing) will be described. When the fixing processing is being executed, the pressing area N is set in the pressurized condition.

At the beginning, the control device 47 controls to drive the driving motor M1, the IH coil 24B, and so forth. The fixing belt 21 rotates by receiving a driving force of the driving motor M1 and the pressing roller 22 rotates by following the fixing belt 21 (see thin solid arrows in FIG. 3). The IH coil 24B generates a magnetic field by receiving power from a power source (not shown), so as to inductively heat the fixing belt 21. The belt guide 27 is self-heated by absorbing a leakage magnetic flux passing through the fixing belt 21, so as to auxiliary heat the fixing belt 21. The temperature sensor detects the surface temperature of the fixing belt 21, and transmits a detection signal through input circuitry to the control device 47. On receiving the detection signal indicating that a setting temperature (e.g., 150 degrees Celsius to 200 degrees Celsius) is attained from the temperature sensor, the control device 47 starts to execute the above-described image forming process with controlling the IH coil 24B to maintain the setting temperature. The sheet S on which the toner image is transferred enters the housing 20, and the fixing belt 21, with rotating around the axis thereof, heats the toner (the toner image) on the sheet S passing through the pressing area N. The pressing roller 22, with rotating around the axis thereof, presses the toner on the sheet S passing through the pressing area N. Then the toner image is fixed on the sheet S. The sheet S on which the toner image has been fixed is fed to the outside of the housing 20 so as to be ejected to the sheet ejecting tray 4.

In a stop (suspended) period of the color printer 1, in an occasion when a conveying failure (a jam) of the sheet S occurs in the fixing device 7, in an occasion when the image forming process (the fixing processing) is executed on a medium such as an envelope that easily wrinkles, or in the like cases, the control device 47 controls to drive the cam motor M2 so that the pressing area N is set in the depressurized condition (see FIG. 6).

In the color printer 1, the sheet S may lodge (the jam may occur) at the pressing area N of the fixing device 7, roller pairs on the conveying paths 8, 9, or the like. In order to remove the lodged sheet S, the opening/closing door 2A is openably and closably provided on the rear surface of the main body 2 (see FIGS. 1 and 2). The opening/closing door 2A is provided rotatably around an opening/closing shaft 2B at the lower part thereof (see FIGS. 2 and 7). The control device 47 detects the jam by receiving an output from jam sensors (not shown) located inside the fixing device 7, on the conveying path 8, or the like. When detecting the jam, the control device 47 halts the image forming apparatus and displays a message or the like indicating generation of the jam on a liquid crystal screen (not shown) or the like. A user executes jam treatment according to the message. That is, the user exposes the conveying path 8, the fixing device 7, or the like by opening the opening/closing door 2A (see FIG. 7), and removes the lodged sheet S.

When the jam occurs in the fixing device 7 (at the pressing area N set in the pressurized condition), the user extracts the sheet S toward an upstream side or a downstream side in the conveying direction. In this case, the sheet S stops while being sandwiched between the fixing belt 21 and the pressing belt 22 with high pressure. Consequently, it is feared that the jam treatment cannot be easily done by the user since it is necessary to extract the sheet S with great force. Thus, the color printer 1 in accordance with the present embodiment has an auxiliary device 40 to facilitate the jam treatment.

<<Auxiliary Device>>

Figure 8A:
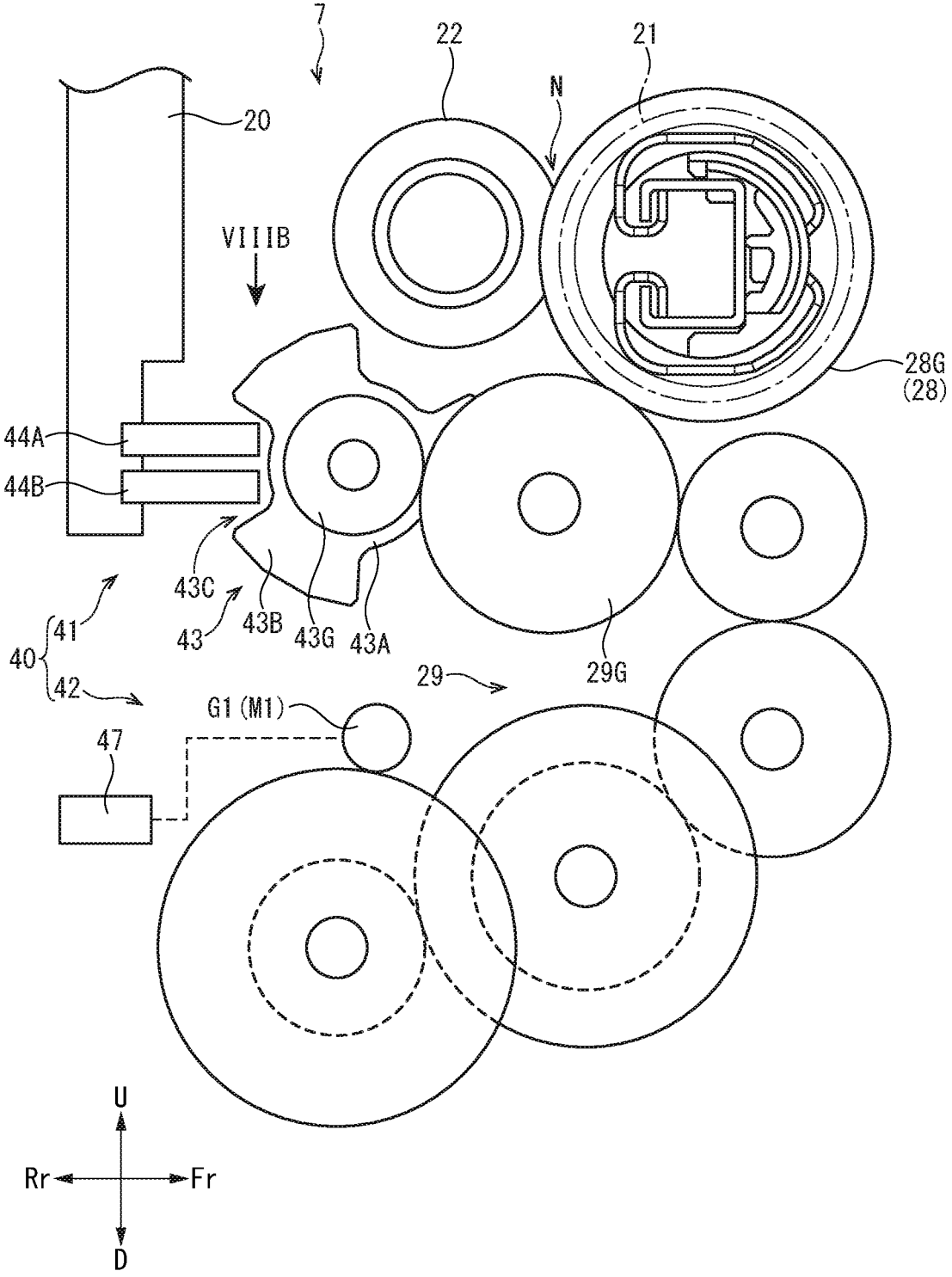
FIG. 8A is a side view that schematically shows the fixing device according to the embodiment of the present invention.
Figure 8B:
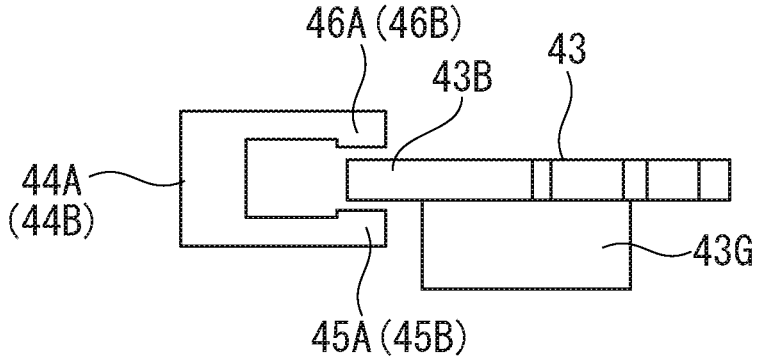
FIG. 8B is a figure viewing from an arrow VIIIB shown in FIG. 8A.
Figure 9:
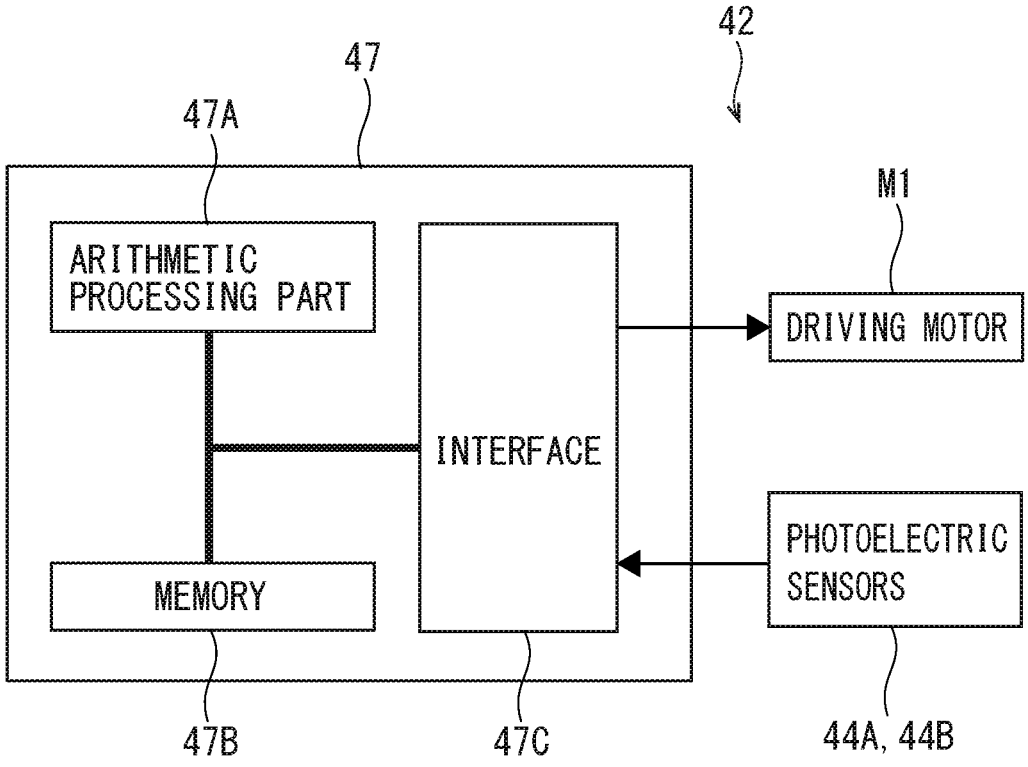
FIG. 9 is a block diagram that shows a control device and so forth of the fixing device according to the embodiment of the present invention.

With reference to FIGS. 8A, 8B, and 9, the auxiliary device 40 will be described. FIG. 8A is a side view that schematically shows the fixing device 7, and FIG. 8B is a figure viewing from an arrow VIIIB shown in FIG. 8A. FIG. 9 is a block diagram that shows a control device 47 and so forth.

As shown in FIG. 8A, the auxiliary device 40 includes a rotation detector 41, an auxiliary driving part 42, and the pressure adjusting part 23 (see FIG. 4 or the like). The rotation detector 41 has a function to detect rotation of the fixing belt 21. The auxiliary driving part 42 has a function to control the driving motor M1 based on a detection result by the rotation detector 41. As stated above, the pressure adjusting part 23 has functions to pressurize the pressing area N by moving the pressing roller 22 in a direction approaching the fixing belt 21 and to depressurize the pressing area N by moving the pressing roller 22 in a direction separating from the fixing belt 21.

<Rotation Detector>

The rotation detector 41 includes a pulse plate 43 and two photoelectric sensors 44A, 44B. The pulse plate 43 is supported rotatably around an axis thereof by the housing 20. The two photoelectric sensors 44A, 44B are supported at positions adjacent to the pulse plate 43 by the housing 20.

The pulse plate 43 is formed in a shape (a three-arrow shape) having three light shielding pieces 43B elongated in radical directions from a circumference of a disk part 43A. The three light shielding pieces 43B are arranged at regular intervals in the circumferential direction of the disk part 43A, and gaps 43C are formed between adjacent light shielding pieces 43B. That is, the pulse plate 43 has the three light shielding pieces 43B and the three gaps 43C alternately arranged in the circumferential direction. A detection gear 43G that gears a final gear 29G of the gear train 29 is fixed to the disk part 43A of the pulse plate 43. The detection gear 43G is a so-called spur gear that is provided on the same axial center of the disk part 43A. The pulse plate 43 rotates around an axis thereof and in the same direction of the fixing belt 21 in synchronization with a rotation of the fixing belt 21.

The two photoelectric sensors 44A, 44B are transmission photoelectric sensors that respectively have light emitting parts 45A, 45B and light receiving parts 46A, 46B facing each other across the light shielding pieces 43B of the pulse plates 43 (see FIG. 8B). The photoelectric sensors 44A, 44B respectively detect lights emitted from the light emitting part 45A, 45B through the gaps 43C using the light receiving parts 46A, 46B. Each of the photoelectric sensors 44A, 44B outputs a pulse signal approximate to a sinusoidal waveform in association with the rotation of the pulse plate 43 (see FIG. 11 or the like). The two photoelectric sensors 44A, 44B are adjacent to the rear side of the pulse plate 43 and vertically juxtaposed. The photoelectric sensors 44A, 44B are arranged so as to output pulse signals whose phases are different from each other by a ¼ cycle. That is, the two photoelectric sensors 44A, 44B are arranged so as to executing state transition, among a state in which the two photoelectric sensors 44A, 44B simultaneously receives the lights, a state in which the two photoelectric sensors 44A, 44B simultaneously receives no light, and a state in which only either one of the two photoelectric sensors 44A, 44B receives the light (that is, a state in which only either one of the two photoelectric sensors 44A, 44B does not receive the light), in accordance with the rotation of the pulse plate 43.

<Auxiliary Driving Part>

As shown in FIG. 8A, the auxiliary driving part 42 includes the driving motor M1 (a driving source) and the control device 47 (a controller). As stated above, the driving motor M1 is the driving source for rotating the fixing belt 21 around the axis thereof. The control device 47 is a composition for controlling the color printer 1 and also a compositional element of the auxiliary device 40.

The driving motor M1 is, for example, an electric motor such as a stepping motor or a speed control motor in which a rotational speed is controllable.

As shown in FIG. 9, the control device 47 includes an arithmetic processing part 47A, a memory 47B, and an interface 47C. The arithmetic processing part 47A executes arithmetic processing according to a program or the like. The memory 47B stores programs, data, and so forth used in various controlling (e.g., pitches of the light shielding pieces 43B (the gaps 43C) of the pulse plate 43, information regarding rotational speed control of the driving motor M1, numbers of gear teeth and gear ratios in the gears of the gear train 29 and so on, and so forth). The memory 47B may store an arithmetic result or the like by the arithmetic processing part 47A. Various devices (abbreviated in FIG. 9) such as the driving motor M1, the photoelectric sensors 44A, 44B, and so forth in the color printer 1 are connected to the control device 47 through the interface 47C. The control device 47 makes a determination of a rotating direction and a rotational speed based on the detection results by the two photoelectric sensors 44A, 44B and controls a rotating direction and a rotational speed of the driving motor M1 based on the determination.

<<Operations of Auxiliary Device>>

Figure 10:
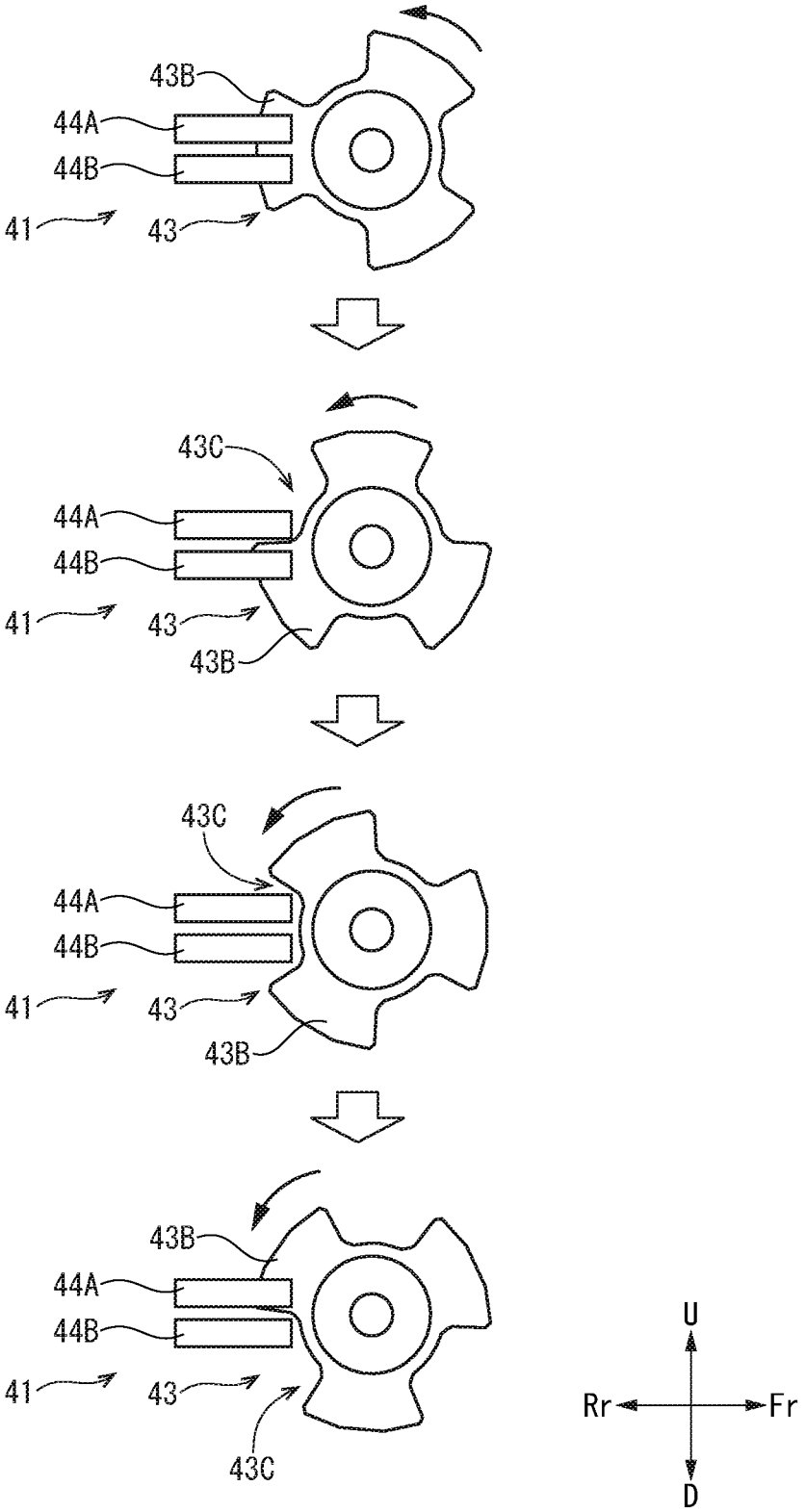
FIG. 10 is an explanatory diagram (a side view) that explains an operation (a counterclockwise rotation) of a rotation detector of the fixing device according to the embodiment of the present invention.
Figure 11:
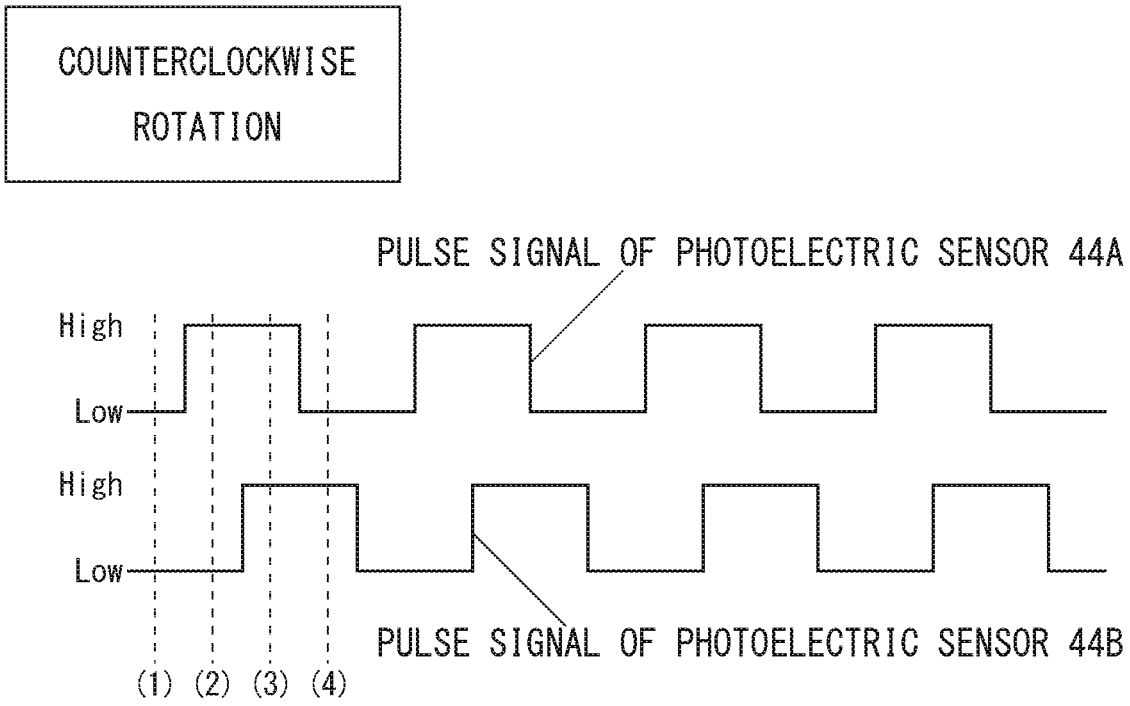
FIG. 11 is an explanatory diagram that shows pulse signals (the counterclockwise rotation) output by two photoelectric sensors of the fixing device according to the embodiment of the present invention.
Figure 12:
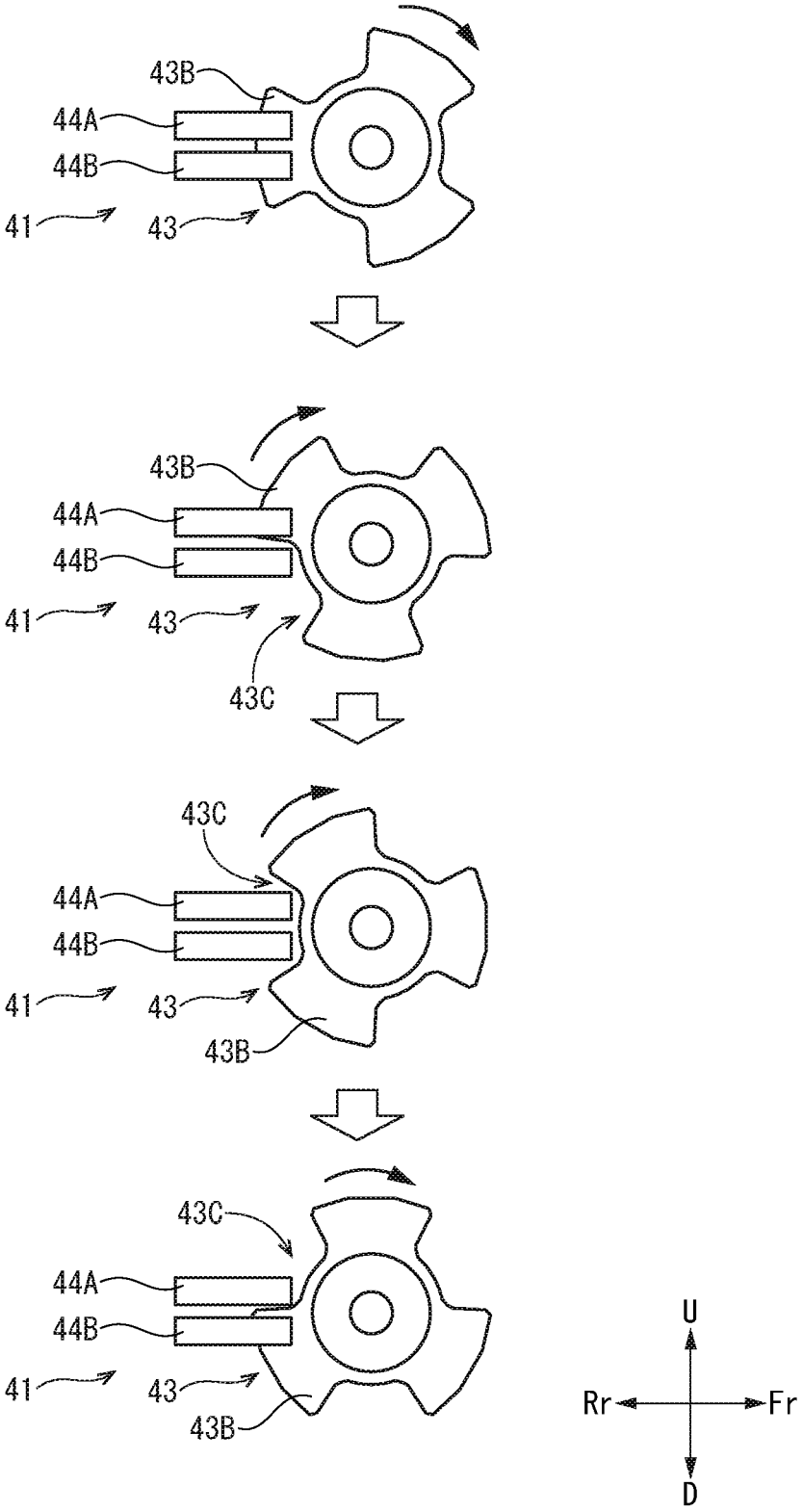
FIG. 12 is an explanatory diagram (a side view) that explains an operation (a clockwise rotation) of the rotation detector of the fixing device according to the embodiment of the present invention.
Figure 13:
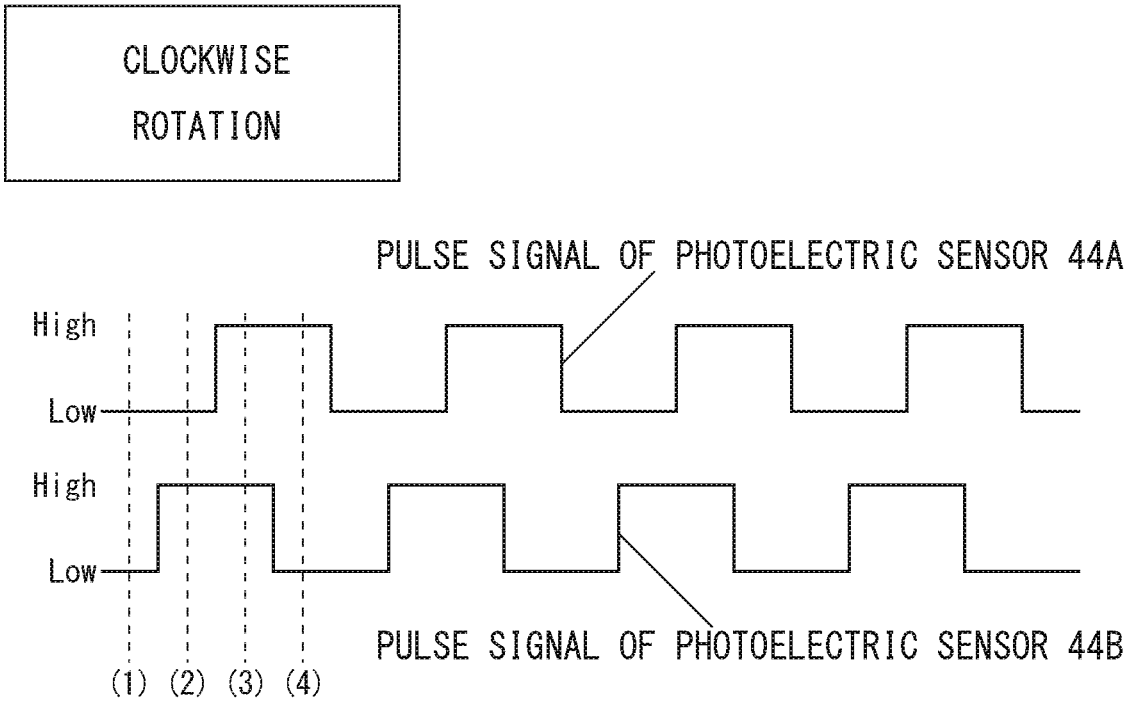
FIG. 13 is an explanatory diagram that shows pulse signals (the clockwise rotation) output by the two photoelectric sensors of the fixing device according to the embodiment of the present invention.

Subsequently, with reference to FIGS. 8A, 8B, and FIGS. 10 to 13, operations of the auxiliary device 40 (procedures of the jam treatment) will be described. FIG. 10 is an explanatory diagram (a side view) that explains an operation (a counterclockwise rotation) of the rotation detector 41. FIG. 11 is an explanatory diagram that shows pulse signals (the counterclockwise rotation) output by the two photoelectric sensors 44A, 44B. FIG. 12 is an explanatory diagram (a side view) that explains an operation (a clockwise rotation) of the rotation detector 41. FIG. 13 is an explanatory diagram that shows pulse signals (the clockwise rotation) output by the two photoelectric sensors 44A, 44B.

When the conveying failure (the jam) of the sheet S occurs at the pressing area N of the fixing device 7, the control device 47 displays the message on the liquid crystal screen or the like. The user exposes the conveying path 8 and the fixing device 7 by backwardly turning the opening/closing door 2A around the opening/closing shaft 2B (see FIG. 7). The user is able to remove the sheet S lodged in the conveying path 8 in this condition. Furthermore, a switch (not shown) to detect opening/closing the opening/closing door 2A is provided in the main body 2. When detecting opening the opening/closing door 2A through the switch, the control device 47 drives the cam motor M2, which sets the pressing area N from the pressurized control to the depressurized condition (see FIG. 6).

Subsequently, it will be described when the sheet S stops with being sandwiched between the fixing belt 21 and the pressing roller 22 (when the jam occurs at the pressing area N). The user draws the sheet S toward an upstream side (a lower direction) or a downstream side (an upper direction) in the conveying direction (the passing direction) (see dashed and double-dotted lines in FIG. 7). The pressing area N is set in the depressurized condition. Consequently, the user can extract the sheet S with smaller force compared to the state in which the pressing area N is set in the pressurized condition.

First, for example, it will be described when the user draws the sheet S toward the upstream side in the conveying direction. In following description, a criterion of rotating directions of the fixing belt 21 and so forth is the rotating directions of the fixing belt 21 and so forth in FIG. 8A.

When the user draws the sheet S toward the upstream side, in association with extracting the sheet S from the pressing area N, the fixing belt 21 rotates counterclockwise and the pressing roller 22 rotates clockwise. The pulse plate 43 also rotates counterclockwise.

As shown in the top step of FIG. 10, for example, when the two photoelectric sensors 44A, 44B face the light shielding piece 43B of the pulse plate 43, lights from the light emitting parts 45A, 45B are shielded by the light shielding piece 43B. Consequently, the photoelectric sensors 44A, 44B respectively output pulse signals indicating Low (OFF) (see (1) in FIG. 11).

As shown in the second step of FIG. 10, when the pulse plate 43 further rotates, the photoelectric sensor 44B remains to face the light shielding piece 43B, whereas the photoelectric sensor 44A becomes to face the gap 43C of the pulse plate 43. Since the light from the light emitting part 45A passes the gap 43C and enters the light receiving part 46A, the photoelectric sensor 44A outputs a pulse signal indicating High (ON) (see (2) in FIG. 11). Still the photoelectric sensor 44B remains to output Low (OFF).

As shown in the third step of FIG. 10, when the pulse plate 43 furthermore rotates, the two photoelectric sensors 44A, 44B face the gaps 43C of the pulse plate 43, so as to output High (ON) (see (3) in FIG. 11). As shown in the bottom step of FIG. 10, when the pulse plate 43 furthermore rotates, the photoelectric sensor 44B remains to face the gap 43C, whereas the photoelectric sensor 44A becomes to face the light shielding piece 43B. Consequently, the photoelectric sensor 44A outputs Low (OFF), and the photoelectric sensor 44B remains to output High (ON) (see (4) in FIG. 11). When the pulse plate 43 further rotates, it returns to the state shown in the top step of FIG. 10.

When receiving the pulse signals shown in FIG. 11 from the two photoelectric sensors 44A, 44B, the control device 47 determines that extracting the sheet S by the user is ongoing and that the pulse plate 43 (the fixing belt 21) is rotating counterclockwise. The control device 47 calculates a rotational speed of the fixing belt 21 based on a period of one cycle of the pulse signal, the number of output pulses per one cycle, and so forth. Further, the control device 47 determines whether or not extracting the sheet S by the user is ongoing by measuring change of a rotational frequency of the driving motor M1, change of a current value flowing the driving motor M1, and so forth. When extracting the sheet S is ongoing, the control device 47 drives to rotate the driving motor M1 so that the fixing belt 21 rotates according to the determined rotating direction and the determined rotational speed. From the pressing area N, the user extracts the sheet S fed toward the upstream side in the conveying direction by the fixing belt 21 rotating counterclockwise.

When extracting the sheet S is interrupted (the sheet S is completely extracted), the control device 47 stops the rotary drive of the driving motor M1. As stated above, the sheet S lodged at the pressing area N is removed. The user closes the opening/closing door 2A and finishes the jam treatment. Alternatively, the control device 47 may determine that the sheet S is extracted by output from the jam sensor (not shown) located inside the fixing device 7 or on the conveying path 8, and may stop the rotary drive of the driving motor M1.

In contrast, when the user draws the sheet S toward the downstream side in the conveying direction, the fixing belt 21 and the pulse plate 43 rotate clockwise, and the pressing roller 22 rotates counterclockwise. When the pulse plate 43 rotates clockwise from a state in which the two photoelectric sensors 44A, 44B face the light shielding piece 43B of the pulse plate 43 (Low (see (1) of FIG. 13)) as shown in the top step of FIG. 12, the photoelectric sensor 44A remains to face the light shielding piece 43B and the photoelectric sensor 44B becomes to face the gap 43C of the pulse plate 43 as shown in the second step of FIG. 12. Consequently, the photoelectric sensor 44A remains to output Low and the photoelectric sensor 44B outputs High (see (2) of FIG. 13).

As shown in the third step of FIG. 12, when the pulse plate 43 further rotates, the two photoelectric sensors 44A, 44B face the gaps 43C of the pulse plate 43 and output High (see (3) of FIG. 13). As shown in the bottom step of FIG. 12, when the pulse plate 43 furthermore rotates, the photoelectric sensor 44A remains to output High and the photoelectric sensor 44B faces the light shielding piece 43B and outputs Low (see (4) of FIG. 13).

When receiving the pulse signals as stated above from the two photoelectric sensors 44A, 44B, the control device 47 determines that extracting the sheet S is ongoing and that the pulse plate 47 rotates clockwise. Explanations regarding other controlling of the control device 47 are substantially identical to controlling stated above in which the pulse plate 43 rotates counterclockwise, so they will be omitted.

With respect to the fixing device 7 in accordance with the above-described embodiment, when the jam occurs at the pressing area N, the rotation detector 41 detects the rotation of the fixing belt 21 generated in the process of extracting the sheet S toward the upstream side or the downstream side in the conveying direction (the passing direction). While the sheet S is being extracted, the auxiliary driving part 42 determines the rotating direction of the fixing belt 21 based on the detection result by the rotation detector 41, and rotates the fixing belt 21 in the rotating direction. According to the above configuration, the fixing belt 21 rotates in the rotating direction corresponding to a direction of extracting the sheet S, which can cause the sheet S to be fed in the direction of extracting the sheet S. Consequently, a load by extracting the sheet S can be reduced, which can effectively restrain from tearing the sheet S and so forth during the jam treatment. Further, according to the above configuration, the fixing belt 21 rotates while the sheet S is being extracted, which can restrain from collapsing a shape of the sheet S in comparison with a case in which the sheet S is forced to be fed out regardless of extracting the sheet S or not. As stated above, the appropriate jam treatment is easily executed by rotating the fixing belt 21 so as to assist in extracting the sheet S.

With respect to the fixing device 7 in accordance with the embodiment, the auxiliary driving part 42 calculates the rotational speed of the fixing belt 21 based on the detection result by the rotation detector 41 and rotates the fixing belt 21 at the rotational speed. According to the above configuration, the fixing belt 21 can be rotated at the rotational speed corresponding to a speed extracting the sheet S, which can appropriately assist the extracting operation of the sheet S. As a result, the user can naturally execute the extracting operation of the sheet S.

With respect to the fixing device 7 in accordance with the embodiment, the rotating direction and the rotational speed of the pulse plate 43 can be detected by providing the two photoelectric sensors 44A, 44B. Consequently, the fixing belt 21 that rotates in the same direction of the pulse plate 43 can be rotated in the determined rotating direction and at the determined rotational speed, which can assist the extracting operation of the sheet S.

With respect to the fixing device 7 in accordance with the embodiment, since the pressure acting on the pressing area N can be weakened by the pressure adjusting part 23 during executing the jam treatment, the extracting operation of the sheet S can be executed with smaller force.

With respect to the color printer 1 in accordance with the embodiment, an image forming apparatus including the above-described fixing device 7 is materialized.

In the fixing device 7 in accordance with the embodiment, the auxiliary driving part 42 (the control device 47) calculates the rotational speed of the fixing belt 21 corresponding to the speed extracting the sheet S in addition to the rotating direction of the fixing belt 21, and rotates the fixing belt 21 at the rotational speed. However, the present invention is not limited to the above. For example, the auxiliary driving part 42 may skip the calculation of the rotational speed of the fixing belt 21 and may rotate the fixing belt 21 at a predetermined constant rotational speed.

In the fixing device 7 in accordance with the embodiment, the auxiliary driving part 42 includes the two photoelectric sensors 44A, 44B, without limitation. Alternatively, three or more of the photoelectric sensors 44A, 44B may be provided. In this case, it is preferable that the three or more photoelectric sensors 44A, 44B be arranged so as to output pulse signals enable the rotation direction of the fixing belt 21 (the pulse plate 43) to be determined. The three light shielding pieces 43B (the gaps 43C) are formed in the pulse plate 43. Alternatively, four or more of the light shielding pieces 43B (the gaps 43C) may be formed therein.

In the fixing device 7 in accordance with the embodiment, the jam treatment is executed in a condition in which the pressure adjusting part 23 depressurizes the pressing area N. However, the present invention is not limited to the above. As stated above, since the fixing belt 21 rotates corresponding to the direction of extracting the sheet S, necessary force to extract the sheet S can be restrained. Therefore, the depressurizing operation of the pressing area N by the pressure adjusting part 23 can be skipped.

In the fixing device 7 in accordance with the embodiment, the pressure adjusting part 23 moves the pressing roller 22 to adjust the pressure of the pressing area N. However, the present invention is not limited to the above. For example, the pressure adjusting part 23 may be configured to move the fixing belt 21 to adjust the pressure of the pressing area N.

In the fixing device 7 in accordance with the embodiment, the fixing belt 21 is driven to rotate, with no limitation. The pressing roller 22 may be driven to rotate. In this case, the rotation detector 41 may detect the rotation of the pressing roller 22 generated in the process of extracting the sheet S. The auxiliary driving part 42 may make a determination of the rotating direction and the rotational speed of the pressing roller 22 based on the detection result by the rotation detector 41, and may rotate the pressing roller 22 based on the determination. Further, in the fixing device 7, the fixing belt 21 is used as a fixing member, with no limitation. Alternatively, a fixing roller (not shown) in which an elastic layer is laminated on a core metal may be used as a fixing member.

In the above description of the embodiment, it is exemplified that the present invention is applied to the color printer 1, with no limitation. For example, the present invention may be applied to a monochrome printer, a copying machine, a facsimile, a multifunction peripheral, or the like.

The above description of the embodiment shows an aspect in the fixing device and the image forming apparatus in accordance with the present invention, and a technical scope of the present invention is not limited to the above-described embodiment.

The invention claimed is:

1. A fixing device comprising:

a fixing member, with rotating around an axis thereof, heating a toner image on a medium;

a pressing member, with rotating around an axis thereof, forming a pressing area with the fixing member and pressing toner on the medium passing through the pressing area;

a rotation detector, when the medium stops while being sandwiched between the fixing member and the pressing member, detecting rotation of the fixing member or the pressing member generated in a process of extracting the medium toward an upstream side or a downstream side in a passing direction; an auxiliary driving part, while the medium is being extracted, determining a rotating direction of the fixing member or the pressing member based on a detection result by the rotation detector, and rotating the fixing member or the pressing member in the rotating direction;

a pressure adjusting part pressurizing the pressing area by moving one of the fixing member and the pressing member in a direction approaching the other of the fixing member and the pressing member, and depressurizing the pressing area by moving one of the fixing member and the pressing member in a direction separating from the other of the fixing member and the pressing member; and a first motor driving rotation the fixing member or the pressing member around an axis, wherein the pressure adjusting part includes a second motor driving movement one of the fixing member and the pressing member, when the medium stops in a state sandwiched between the fixing member and the pressing member, the pressure adjusting part moves the one of the fixing member and the pressing member in the direction separating from the other of the fixing member and the pressing member by the second motor, and, after this state, while the medium is extracted, the auxiliary driving part calculates a rotational speed of the fixing member or the pressing member based on the detection result by the rotation detector and rotates the fixing member or the pressing member at the rotational speed in the rotating direction of the fixing member or the pressing member by the first motor.

2. The fixing device according to claim 1, wherein the rotation detector includes:

a pulse plate that has a plurality of light shielding pieces arranged in a circumferential direction and that rotates around an axis thereof and in a same direction of the fixing member or the pressing member in synchronization with a rotation of the fixing member or the pressing member; and a plurality of sensors each of which has a light emitting part and a light receiving part that face each other across the pulse plate and each of which detects light passing through a gap formed between the adjacent light shielding pieces, and wherein the auxiliary driving part includes:

the first motor that rotates the fixing member or the pressing member around the axis thereof; and a controller that makes a determination of the rotating direction and the rotational speed of the fixing member or the pressing member based on detection results by the sensors and controls a rotating direction and a rotational speed of the first motor based on the determination.

3. The fixing device according to claim 2, wherein the pulse plate has the three light shielding pieces arranged in the circumferential direction at regular intervals, and wherein the three light shielding pieces form the three gaps.

4. The fixing device according to claim 2, wherein the fixing member or the pressing member is connected to the first motor through a gear train, the pulse plate includes a detection gear gearing one gear of the gear train, and rotates around an axis and in the same direction of the fixing member or the pressing member in synchronization with the rotation of the fixing member or the pressing member.

5. The fixing device according to claim 4, wherein the pressing member is rotatably supported by a movable frame, wherein the pressure adjusting part includes:

a pressing arm located in a rear side of the movable frame; and an eccentric cam on which a pressurizing cam surface and a depressurizing cam surface with an eccentric radium greater than that of the pressurizing cam surface are formed, and wherein the pressing member moves in the direction separating from the fixing member by contacting the depressurizing cam surface of the eccentric cam with the pressing arm, so that the pressing area is depressurized.

6. An image forming apparatus comprising the fixing device according to claim 1.

* * * * *